US010808470B2

(12) United States Patent
Vo

(10) Patent No.: US 10,808,470 B2
(45) Date of Patent: Oct. 20, 2020

(54) SPINNER ASSEMBLY WITH FOUR BAR LINKAGE DEVICE

(71) Applicant: FORUM US, INC, Houston, TX (US)

(72) Inventor: Han Vo, Cypress, TX (US)

(73) Assignee: FORUM US, INC., Houston, TX (US)

( * ) Notice: Subject to any disclaimer, the term of this patent is extended or adjusted under 35 U.S.C. 154(b) by 450 days.

(21) Appl. No.: 15/609,304

(22) Filed: May 31, 2017

(65) Prior Publication Data

US 2018/0347296 A1 Dec. 6, 2018

(51) Int. Cl.
*E21B 19/16* (2006.01)

(52) U.S. Cl.
CPC ..... *E21B 19/161* (2013.01); *E21B 19/163* (2013.01); *E21B 19/168* (2013.01)

(58) Field of Classification Search
CPC ..... E21B 19/161; E21B 19/168; B25B 17/00; B25B 13/481; B25B 13/467; B25B 17/02; B25B 21/002
See application file for complete search history.

(56) References Cited

U.S. PATENT DOCUMENTS 4,366,606 A * 1/1983 Willis ..... E21B 19/06 269/218
5,054,550 A * 10/1991 Hodge ..... E21B 19/168 166/78.1
6,966,385 B2 * 11/2005 Hemphill ..... E21B 19/165 166/380
7,036,396 B2 * 5/2006 Moe ..... E21B 19/168 81/57.2
7,188,547 B1 3/2007 West et al.
8,042,432 B2 10/2011 Hunter et al.
8,074,537 B2 * 12/2011 Hunter ..... E21B 19/168 81/57.2
8,490,520 B2 7/2013 Hunter
8,601,910 B2 * 12/2013 Begnaud ..... E21B 19/168 166/77.51
8,783,137 B2 7/2014 Hamilton
2005/0047884 A1 * 3/2005 Belik ..... E21B 19/00 408/234
2005/0076744 A1 4/2005 Pietras et al.
2009/0272235 A1 11/2009 Berry
2009/0301262 A1 12/2009 Drzewiecki
2015/0275599 A1 10/2015 Russo
2018/0015593 A1 * 1/2018 Wang ..... B25B 13/14

OTHER PUBLICATIONS

International Search Report and Written Opinion dated Aug. 3, 2018, Corresponding to Application No. PCT/US2018/031960.

* cited by examiner

*Primary Examiner* — Joseph J Hail
*Assistant Examiner* — J Stephen Taylor
(74) *Attorney, Agent, or Firm* — Patterson & Sheridan, L.L.P.

(57) ABSTRACT

A spinner assembly including a jaw assembly having a first portion and a second portion, and a linkage assembly coupled to the first and second portions of the jaw assembly. The linkage assembly comprises a first bar coupled to a pivot point, a second bar coupled to the first bar by a first pin, a third bar coupled to the second bar by a second pin, and a pair of links coupled to the pivot point and the third bar. The linkage assembly is configured to move the first and second portions along a substantially linear plane.

11 Claims, 4 Drawing Sheets

SPINNER ASSEMBLY WITH FOUR BAR LINKAGE DEVICE

BACKGROUND

Field

Embodiments disclosed herein relate to a spinner assembly for coupling or de-coupling tubulars in a drilling or workover operation utilized in the oil and gas industry.

Description of the Related Art

A spinner (also known as a "pipe spinner") is commonly used in the oil and gas industry to spin a tubular when making up or breaking out a threaded connection. The spinner rotates an upper tubular relative to a lower tubular to thread the tubulars together during a make-up operation, and rotates the upper tubular in an opposite direction to unthread the tubulars from each other during a break-out operation. The spinner is a relatively low torque, high speed device used for the initial makeup or final break-out of a threaded connection. A torque wrench is subsequently used to provide a greater amount of torque to complete or undo the threaded connection.

The spinner is usually suspended above both the torque wrench and a rotary spider that is located in a rig floor. The spinner has a pair of arms with rollers that are moved into contact with a tubular and are configured to rotate the upper tubular relative to the lower tubular held by the torque wrench and/or the rotary spider to couple the two tubulars together. However, the arms of the spinner generally move along an arcuate path such that one or more of the rollers contact the upper tubular prior to other rollers. Contact between the some of the rollers and the upper tubular prior to the rest of the rollers, while moving along an arcuate path often cause the upper tubular to be pushed out of alignment with the spinner.

Therefore, there exists a need for new and/or improved spinners.

SUMMARY

In one embodiment, a spinner assembly comprises a jaw assembly having a first portion and a second portion, a linkage assembly coupled to the first and second portions of the jaw assembly, wherein the linkage assembly comprises: a first bar coupled to a pivot point, a second bar coupled to the first bar by a first pin, a third bar coupled to the second bar by a second pin, and a pair of links coupled to the pivot point and the third bar, wherein the linkage assembly is configured to move the first and second portions along a substantially linear plane.

In one embodiment, a spinner assembly comprises a jaw assembly having a first portion with a plurality of rollers and a second portion with a plurality of rollers, a linkage assembly coupled to the first and second portions of the jaw assembly, and an actuator configured to actuate the linkage assembly to move the first and second portions toward each other along a straight parallel path to move the plurality of rollers into contact with a tubular.

BRIEF DESCRIPTION OF THE DRAWINGS

To facilitate understanding, identical reference numerals have been used, where possible, to designate identical elements that are common to the figures. It is contemplated that elements disclosed in one embodiment may be beneficially utilized with other embodiments without specific recitation.

DETAILED DESCRIPTION

Embodiments of the disclosure include a spinner assembly for making up and breaking out a threaded connection between two tubulars. The spinner assembly is constructed such that a tubular gripping assembly (or jaw assembly) having a plurality of rollers move along a straight parallel path into contact with a tubular through the use of a four bar linkage device. The parallel travel of the rollers prevents pushing the tubular out of alignment, which minimizes misalignment between the center axis of the spinner assembly and the center axis of a torque wrench that is located below the spinner assembly.

Figure 1A:
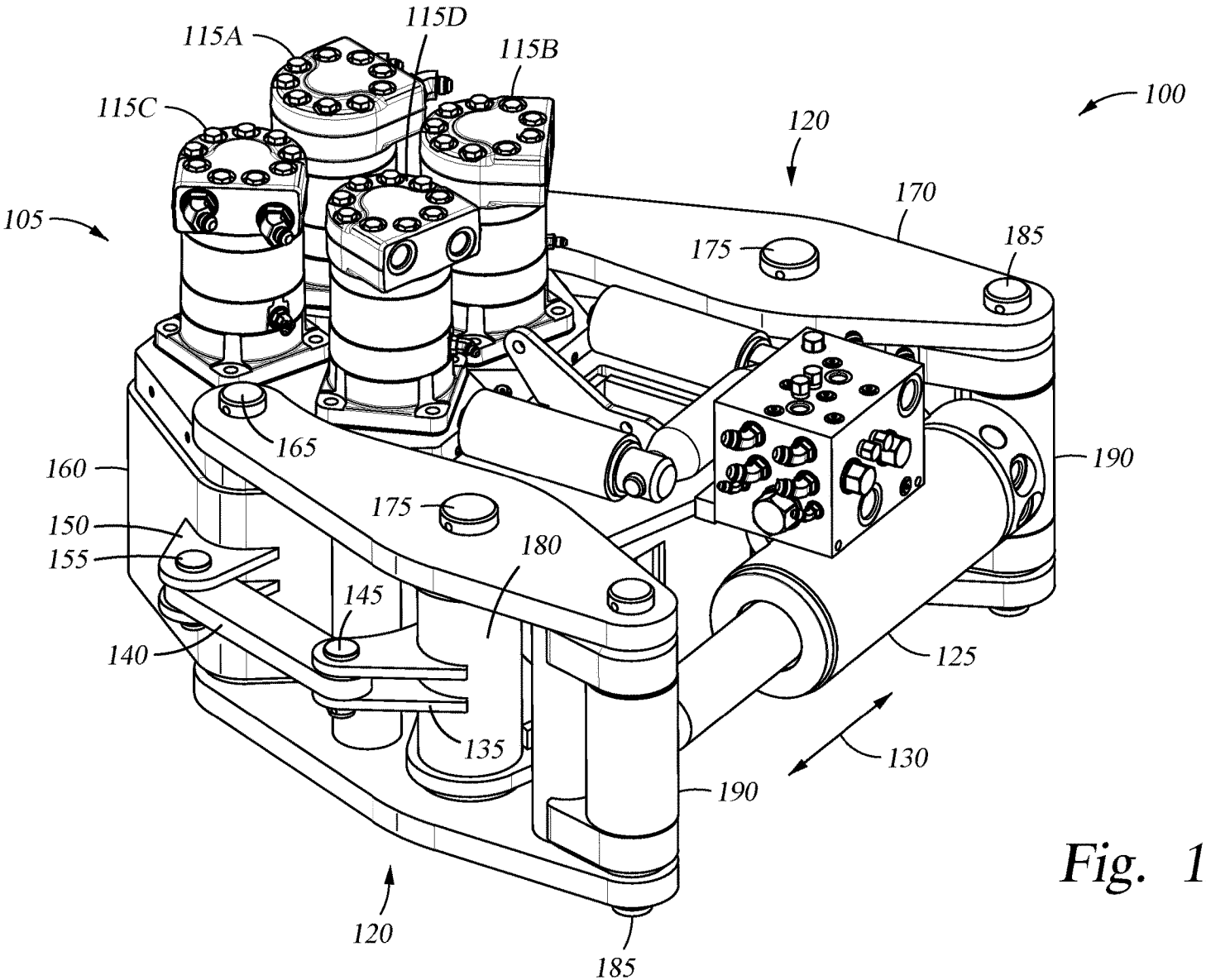
FIGS. 1A and 1B are isometric views of one embodiment of a spinner assembly.
Figure 1B:
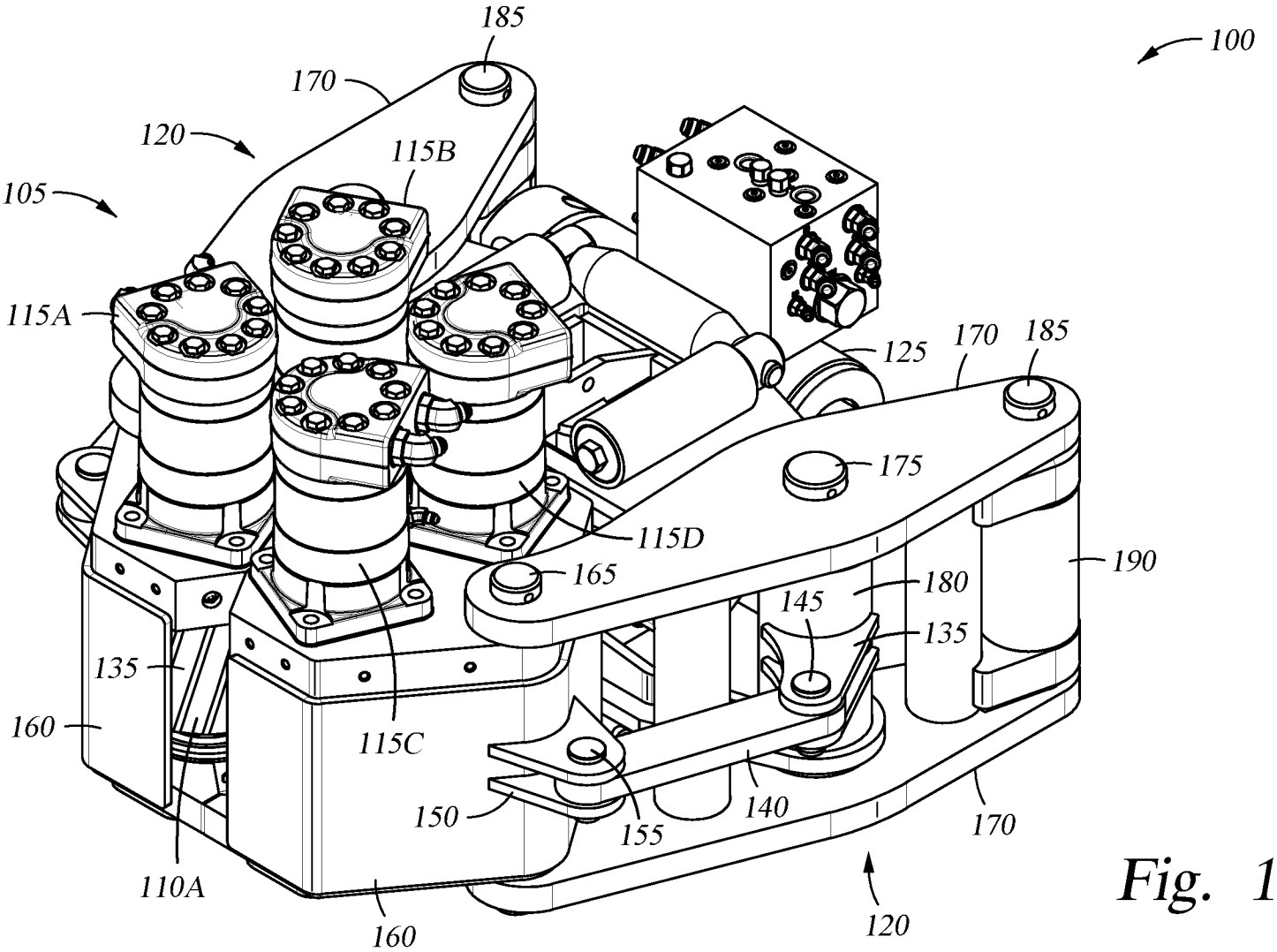
Figure 2:
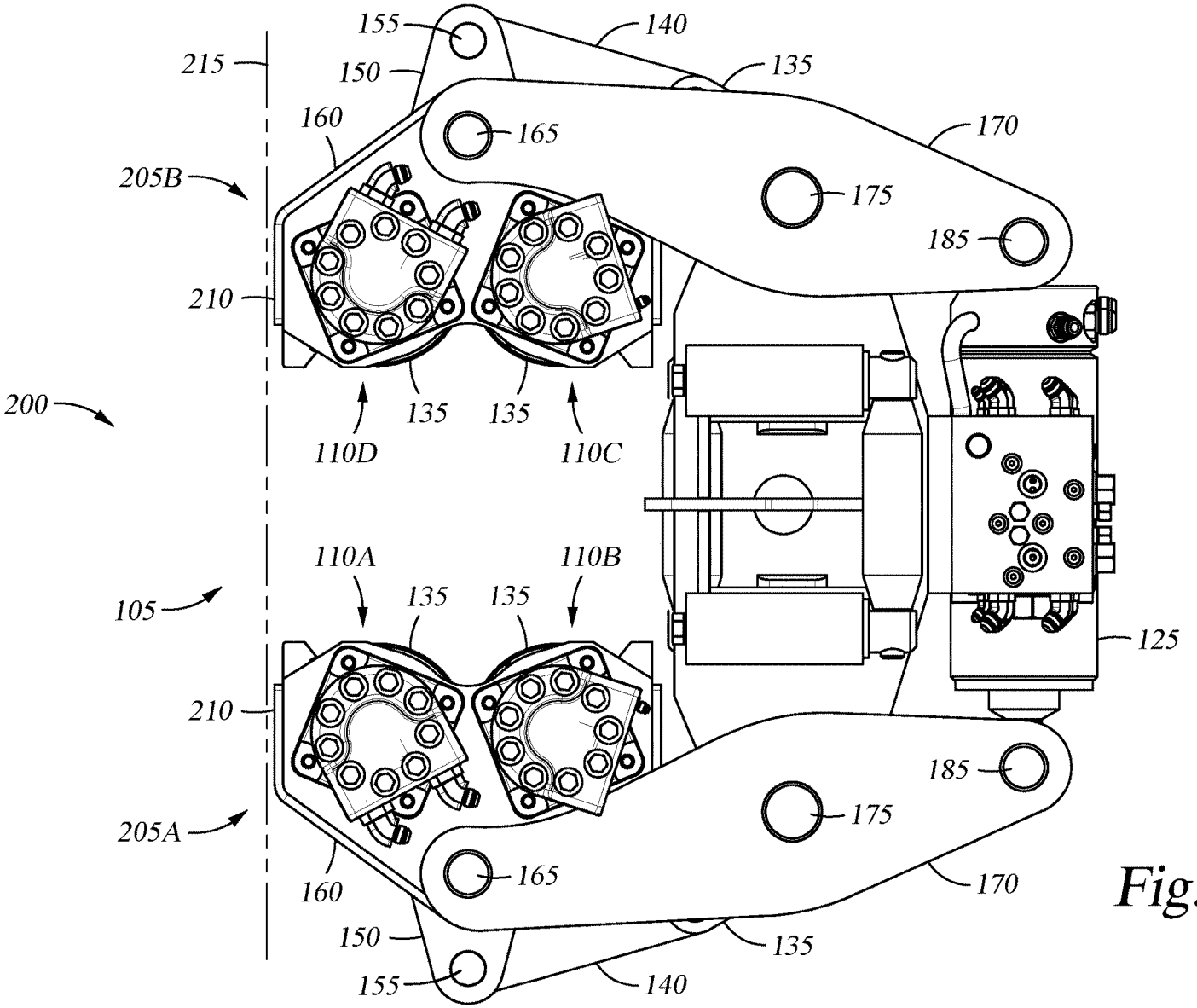
FIG. 2 is a plan view of the spinner assembly of FIGS. 1A and 1B showing a jaw assembly of the spinner assembly in an open position.
Figure 3:
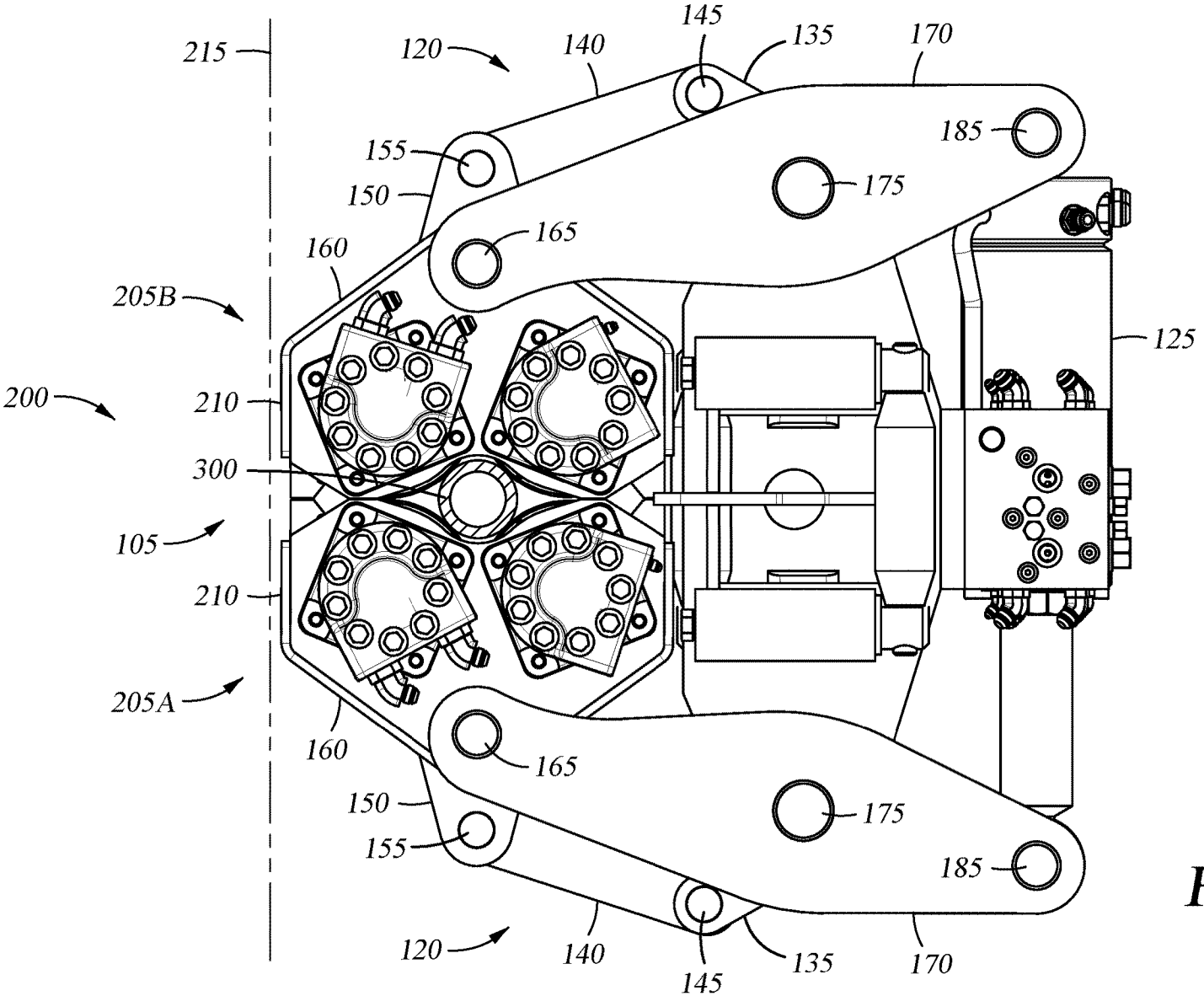
FIG. 3 is a plan view of the spinner assembly of FIGS. 1A and 1B showing the jaw assembly of the spinner assembly in a closed position.

FIGS. 1A and 1B are isometric views of one embodiment of a spinner assembly 100. The spinner assembly 100 includes a jaw assembly 105 having four rollers 110A-110D as shown in FIGS. 2 and 3. The rollers 110A-110D are rotatably driven by respective motors 115A-115D. The motors 115A-115D may be electrically powered or hydraulically powered to rotate the rollers 110A-110D to thereby rotate a tubular (that is in contact with the rollers 110A-110D) in a clockwise direction to make up a threaded connection or a counterclockwise direction to break out a threaded connection.

The jaw assembly 105 is coupled to a linkage assembly 120 that is coupled to an actuator 125. The actuator 125 may be electrically powered or hydraulically powered to move in the direction of arrow 130 to open and close the jaw assembly 105. The open position of the jaw assembly 105 is shown in FIG. 2, and the closed position of the jaw assembly 105 is shown in FIG. 3. Each of the rollers 110A-110D have a surface 135 adapted to contact a tubular when the jaw assembly 105 is in the closed position.

The linkage assembly 120 includes a first bar 135, such as a base bar. The first bar 135 is coupled to a second bar 140 by a first pin 145. The second bar 140 is coupled to a third bar 150 by a second pin 155. The third bar 150 is fixed to a body 160 of the jaw assembly 105, such as by welding. The body 160 has a third pin 165 that couples to a pair of links 170 (or pair of fourth bars) that pivot about a fourth pin 175 which forms a pivot point. The fourth pin 175 extends through both of the links 170 within a bushing 180. The first bar 135 is fixed to the bushing 180. The other end of the links 170 is coupled to a fifth pin 185. The fifth pin 185 extends through the links 170 within a bushing 190. The bushing 190 is coupled to the actuator 125.

FIGS. 2 and 3 are plan views of the spinner assembly 100 showing the jaw assembly 105 in an open position and a closed position, respectively.

The jaw assembly 105 includes a first portion 205A that opposes a second portion 205B. The first portion 205A includes the rollers 110A-110B while the second portion 205B includes the rollers 110C-110D. In the open position as shown in FIG. 2, a gap 200 is provided between the first portion 205A the second portion 205B such that a tubular may be received between the rollers 110A-110D. In the open position, one or more surfaces 210 of the body 160 are positioned along and substantially parallel to a linear plane 215.

In the closed position shown in FIG. 3, the jaw assembly 105 is closed in order to grip a tubular 300. To provide movement from the open position shown in FIG. 2 to the closed position shown in FIG. 3, the actuator 125 is actuated in the direction of arrow 130 (shown in FIG. 1A), which pushes the bushings 190 (shown in FIGS. 1A and 1B) away from each other. The links 170 rotate about the fourth pin 175 which causes the first portion 205A and the second portion 205B to move toward each other about the tubular 300. Opening the jaw assembly 105 is accomplished by retracting the actuator 125 such that the first portion 205A and the second portion 205B move away from each other.

During the opening and closing processes, the linkage assembly 120 maintains a parallel orientation between the first portion 205A and the second portion 205B such that the surfaces 210 move along the linear plane 215 during this movement. The straight, parallel movement of the first portion 205A and the second portion 205B relative to each other and the liner plane 215 allows the rollers 110A-110D to contact the tubular 300 while minimizing any risk of pushing the tubular 300 out of alignment from the substantially vertical direction. During the opening and closing of the jaw assembly 105, the first bar 135 does not move, while the second bar 140 and the third bar 150 maintain the body 160 and the surfaces 210 in a substantially coplanar orientation.

The jaws of the conventional spinners typically move along an arcuate path (e.g. ahead of and behind the linear plane 215). This arcing movement may cause the rollers to push the tubular out of alignment with the center axis of the spinner. However, the spinner assembly 100 as described herein moves the jaw assembly 105 along a straight and parallel path such that the rollers 110A-110D do no push the tubular 300 out of alignment with the center axis of the spinner assembly 100. Regardless of the size of the tubular, the distance of the rollers 110A-110D relative to the front and back of the spinner assembly 100 does not change as the rollers 110A-110D are moved into and out of contact with the tubular. This is due in part because regardless of the size of tubular, the longitudinal, center axis of the tubular will always be the same relative to the longitudinal center axis of the spinner assembly 100.

While the foregoing is directed to embodiments of the disclosure, other and further embodiments of the disclosure thus may be devised without departing from the basic scope thereof, and the scope thereof is determined by the claims that follow.

The invention claimed is:

1. A spinner assembly, comprising:

a jaw assembly having a first body adjacent to a second body, the first body comprising one or more rollers and the second body comprising one or more rollers;

an actuator;

a first linkage assembly coupled between the first body of the jaw assembly and the actuator, the first linkage assembly comprising:

a first pair of links, a first bushing extending between the first pair of links, a first bar fixed to the first bushing, a second bar coupled to the first bar of the first linkage assembly by a first pin, a third bar coupled to the second bar of the first linkage assembly by a second pin, wherein the third bar of the first linkage assembly is fixed to the first body, and a fourth pin forming a first pivot point and extending through the first bushing and through the first pair of links; and a second linkage assembly coupled between the second body of the jaw assembly and the actuator, the second linkage assembly comprising:

a second pair of links, a second bushing extending between the second pair of links, a first bar fixed to the second bushing, a second bar coupled to the first bar of the second linkage assembly by a first pin, a third bar coupled to the second bar of the second linkage assembly by a second pin, wherein the third bar of the second linkage assembly is fixed to the second body, and a fourth pin forming a second pivot point and extending through the second bushing and through the second pair of links;

wherein the first linkage assembly and the second linkage assembly are configured to move the first body and the second body laterally along a substantially linear plane toward and away from each other between an open position and a closed position upon actuation and retraction of the actuator, wherein in the open position a gap is between the first body and the second body, and in the closed position the gap is reduced.

2. The spinner assembly of claim 1, wherein the first body of the jaw assembly is coupled to the first pair of links by a third pin of the first linkage assembly and the second body of the jaw assembly is coupled to the second pair of links by a third pin of the second linkage assembly.

3. The spinner assembly of claim 2, wherein the first bar, the second bar, and the third bar of the first linkage assembly are disposed between the first pair of links.

4. The spinner assembly of claim 3, wherein a first end of the actuator is coupled to the first pair of links and a second end of the actuator is coupled to the second pair of links.

5. The spinner assembly of claim 4, wherein the actuator is coupled to a bushing containing a fifth pin of the first linkage assembly to couple the actuator to the first pair of links.

6. The spinner assembly of claim 1, wherein the second bar of the first linkage assembly is between the first bar of the first linkage assembly and the third bar of the first linkage assembly, a first end of the second bar of the first linkage assembly is coupled to the first bar of the first linkage assembly, and a second end of the second bar of the first linkage assembly is coupled to the third bar of the first linkage assembly.

7. A spinner assembly, comprising:

a jaw assembly having a first body adjacent to a second body, the first body comprising one or more rollers and the second body comprising one or more rollers;

an actuator;

a first linkage assembly coupled between the first body of the jaw assembly and the actuator, the first linkage assembly comprising:

a first pair of links, a first bushing extending between the first pair of links, a first bar fixed to the first bushing, a second bar coupled to the first bar of the first linkage assembly by a first pin, a third bar coupled to the second bar of the first linkage assembly by a second pin, wherein the third bar of the first linkage assembly is fixed to the first body, and a fourth pin forming a first pivot point and extending through the first bushing and through the first pair of links; and a second linkage assembly coupled between the second body of the jaw assembly and the actuator, the second linkage assembly comprising:

a second pair of links, a second bushing extending between the second pair of links, a first bar fixed to the second bushing, a second bar coupled to the first bar of the second linkage assembly by a first pin, a third bar coupled to the second bar of the second linkage assembly by a second pin, wherein the third bar of the second linkage assembly is fixed to the second body, and a fourth pin forming a second pivot point and extending through the second bushing and through the second pair of links;

wherein the first linkage assembly and the second linkage assembly are configured to move a first surface of the first body and a second surface of the second body along and parallel to a linear plane between an open position and a closed position upon actuation and retraction of the actuator, wherein in the open position a gap is between the first surface and the second surface, and in the closed position the gap is reduced.

8. The spinner assembly of claim 7, wherein the first body of the jaw assembly is coupled to the first pair of links by a third pin of the first linkage assembly and the second body of the jaw assembly is coupled to the second pair of links by a third pin of the second linkage assembly.

9. The spinner assembly of claim 8, wherein the first bar, the second bar, and the third bar of the first linkage assembly are disposed between the first pair of links.

10. The spinner assembly of claim 9, wherein the actuator is coupled to a bushing containing a fifth pin of the first linkage assembly to couple the actuator to the first pair of links.

11. The spinner assembly of claim 7, wherein the second bar of the first linkage assembly is between the first bar of the first linkage assembly and the third bar of the first linkage assembly, a first end of the second bar of the first linkage assembly is coupled to the first bar of the first linkage assembly, and a second end of the second bar of the first linkage assembly is coupled to the third bar of the first linkage assembly.

* * * * *